US005308584A

United States Patent [19]

Vauramo

[11] Patent Number: 5,308,584

[45] Date of Patent: May 3, 1994

[54] CUVETTE MATRIX TRAY

[75] Inventor: Kari Vauramo, Helsinki, Finland

[73] Assignee: Biohit Oy, Helsinki, Finland

[21] Appl. No.: 942,677

[22] Filed: Sep. 9, 1992

[51] Int. Cl.[5] ..... B01L 3/14

[52] U.S. Cl. ..... 422/104; 422/99; 422/102; 206/558; 206/560; 220/23.83; 220/23.86

[58] Field of Search ..... 422/102, 99, 104; 436/164, 518; 206/558, 560; 220/23.83, 23.86

[56] References Cited

U.S. PATENT DOCUMENTS

| | | | |
|---|---|---|---|
| 4,154,795 | 5/1975 | Thorne | 422/99 |
| 4,246,339 | 1/1981 | Cole et al. | 435/7 |
| 4,319,841 | 3/1982 | Suovaniemi et al. | 422/102 X |
| 4,599,314 | 7/1986 | Shami | 435/287 |
| 4,599,315 | 7/1986 | Terasaki et al. | 435/301 |
| 4,761,378 | 8/1988 | Godsey | 435/293 |
| 4,889,816 | 12/1989 | Davis et al. | 436/518 |
| 4,948,564 | 8/1990 | Root et al. | 422/101 |
| 5,064,756 | 11/1991 | Carr et al. | 435/32 |
| 5,084,246 | 1/1992 | Lyman et al. | 422/101 |
| 5,096,672 | 3/1992 | Tervamaki et al. | 422/102 |
| 5,096,676 | 3/1992 | McPherson et al. | 422/245 |
| 5,110,556 | 5/1992 | Lyman et al. | 422/101 |
| 5,112,574 | 5/1992 | Horton | 422/102 |
| 5,130,105 | 7/1992 | Carter et al. | 422/245 |
| 5,133,939 | 7/1992 | Mahe | 422/104 |
| 5,141,718 | 8/1992 | Clark | 422/99 |
| 5,159,197 | 10/1992 | Wannlund | 422/102 X |

*Primary Examiner*—James C. Housel
*Assistant Examiner*—Harold Y. Pyon
*Attorney, Agent, or Firm*—Kane, Dalsimer, Sullivan, Kurucz, Levy, Eisele and Richard

[57] ABSTRACT

A cuvette matrix tray, comprising a frame (1) and a plurality of strips (4) which are mounted to be borne by the carrying sides of said frame, on at least one carrying side (2,3) being formed inward projecting carrying shoulders (5), and on at least one end of the strip being provided a locking member (6) comprising an outward projecting limiting member (7) disposed to rest against the upper surface (8) of the carrying side, and at least one locking shoulder (9) which is disposed to be pressed in below the carrying shoulder and to rest against the underside thereof when the strip is pushed from above to be borne by the carrying sides.

3 Claims, 1 Drawing Sheet

CUVETTE MATRIX TRAY

Figure 1:
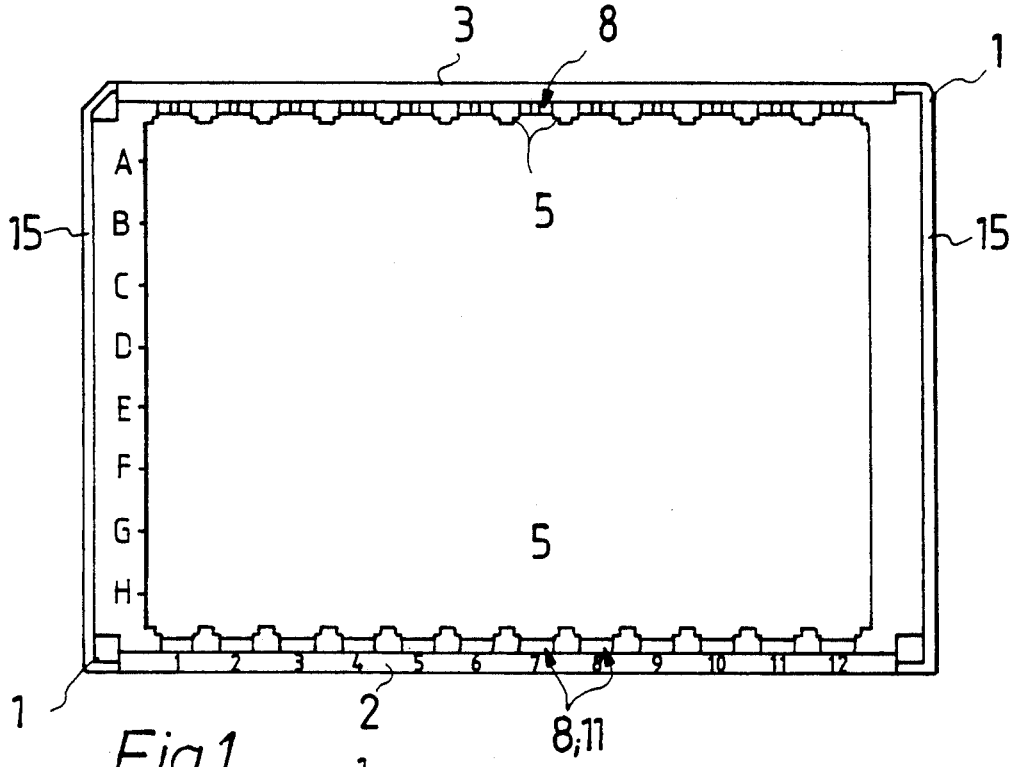

The present invention concerns a cuvette matrix tray, such as a microtitre tray.

The handling of cuvette matrices, such as microtitre trays, imposes exceedingly high requirements on the fixing of the separate rows consisting of individual cuvettes, such as microtitre wells, or of so-called strips. It is repeatedly necessary to detach the strips from the frame of the tray and to restore them to be borne by the frame. It is furthermore necessary to turn the tray about, with its strips, in connection with various handling, washing and drying steps. Therefore the strips must remain firmly in place e.g. when the tray is being turned about, while on the other hand the strips should be easy to detach and easy to remount to be carried by the frame.

Cuvette matrices known in the art, e.g. microtitre trays, fail to meet the requirements stated above. Problems are commonly encountered in particular regarding assured remaining in place of the strips. The aspect of the strips' convenient detachment and remounting is likewise problematic.

The object of the present invention is to eliminate the above-mentioned detriments. It is specifically an object of the invention, to disclose a novel cuvette matrix, such as a microtitre tray, in which the strips are securely held in their places, without inadvertently falling off even if the tray is turned upside down. A further object of the invention is to disclose a microtitre tray in which the strips can be mounted and from which they can be detached with ease.

The invention is based on the fundamental idea that on at least one carrying side of the frame have been formed carrying shoulders projecting towards the interior of the frame, and on at least one end of the strip is provided a locking member comprising an outward projecting limiting member which rests against the upper surface of the carrying side, and at least one locking shoulder disposed to be pressable in below the carrying shoulder and to rest against the underside thereof when the strip is pushed from above to be borne by the carrying sides. Hereby the limiting member of the locking member will confine the downward movement of the strip end, and the locking shoulders together with the carrying shoulders will confine the upward movement of the strip end. Thus, the strip is locked against the side of the frame by said locking member.

Advantageously, carrying shoulders have been formed on either carrying side of the frame, and the strip carried on either end a locking member including a limiting member, arranged to accomplish bracing against the upper surface of the frame and, respectively, against the undersides of two adjacent carrying shoulders, when the strip has been mounted to be borne by the frame.

The locking member advantageously comprises a mainly upright spring member and a limiting member projecting upward therefrom.

The locking shoulders advantageously consist of shoulders formed on the spring member and which project to the sides on a level lower than that of the underside of the limiting member.

On the carrying sides are advantageously formed depressions, and the limiting members are disposed in said depressions.

In a cuvette matrix according to the invention, such as a microtitre tray, the fixing of the strip is eminently secure in practice. The strip will not fall out from the frame even if the tray should be turned upside down; even if the strip is pressed downward while the frame is upside down, the strip will not be detached from the frame. In trials, detachment has only occurred after the locking member has been broken or the shoulders ruptured. On the other hand the strip is easy indeed to press in place to be borne by the carrying sides. Further, when the locking members, i.e., the ends of the strip, are pressed towards each other with simultaneous lifting, the strip becomes detached from the frame with greatest ease and can be removed if desired. By virtue of the spring member, as the spring member pushes the lower part of the strip upward and constitutes an outward projecting limiting member, when the strip that has been mounted to be borne by the frame is pressed upward from the bottom, the spring members tend to push outward, while the strip bends to an arc, and the locking members become even more firmly interlocked with the carrying shoulders.

Proper positioning of the strip is aided by making the underside of the locking shoulder outwardly sloping, or bevelled, so that the bevel will force the elastic locking member inward as it is urged against the carrying shoulders when the strip is pressed into the frame, whereby the locking shoulders snap into locked position, accomplishing positive locking.

Figure 1A:
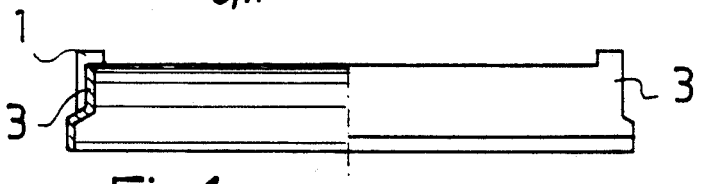
Figure 2:
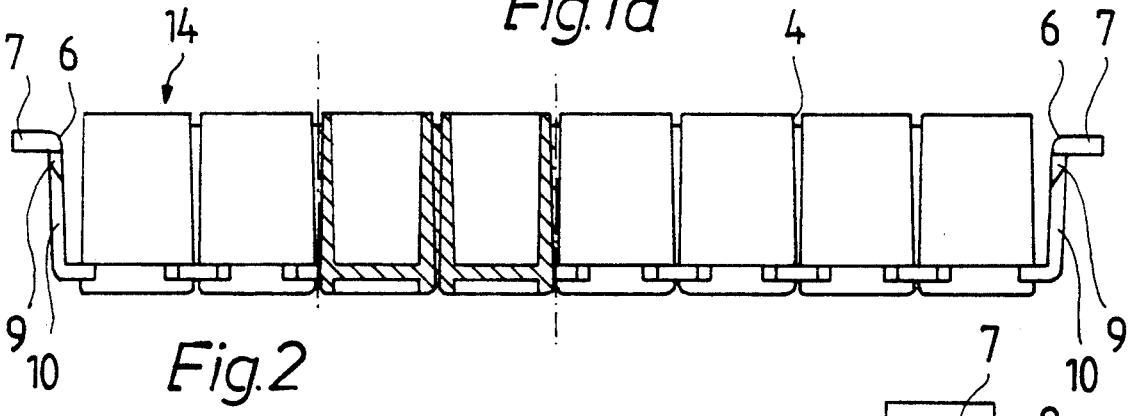
Figure 3:
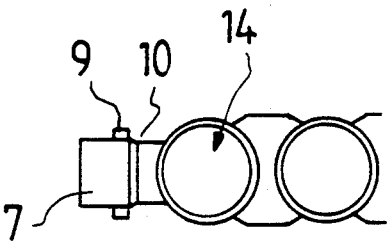
Figure 4:
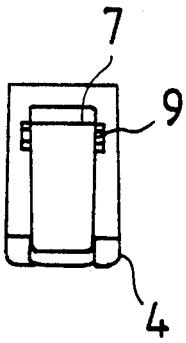

The invention is described in detail in the following with the aid of an embodiment example, referring to the attached drawing, wherein:

FIG. 1 presents a microtitre tray conforming to the invention, in top view and after removal of the strips, FIG. 1*a* presents a cross section of the microtitre tray shown in FIG. 1, FIG. 2 presents a strip intended to be mounted in the frame of FIG. 1, enlarged and in elevational view, FIG. 3 shows the strip of FIG. 2 in top view, and FIG. 4 shows the strip of FIG. 2 in end view.

In FIG. 1 is seen a microtitre tray conforming to the invention, in top view, the strips having been removed. The tray comprises a frame 1 having two mutually parallel carrying sides 2,3 and sides 15 running transversally to these. The frame is substantially rectangular; the cross section is seen in FIG. 1*a*. On the carrying sides 2,3 of the frame 1 carrying shoulders 5 projecting towards the interior of the frame have been provided; the carrying shoulders are located on inner surface of the carrying side, in its upper part.

The strip carries at one end at least, in the embodiment here depicted at both ends, a locking member 6, comprising a limiting member 7, projecting outward in the longitudinal direction of the strip and disposed to rest on the upper surface 8 of the carrying side 2,3, and locking shoulders 9, disposed to be pressed in below the carrying shoulders 5 and to rest against their underside when the strip is pushed from above to become borne by the carrying sides. In the embodiment here depicted, carrying shoulders 5 have been formed on both carrying sides 2,3 of the frame 1, and the strip 4 has on either end a locking member 6, both members having two locking shoulders 9 each, these shoulders being transverse to the longitudinal direction of the strip, i.e. pointing to the sides, and both projecting in opposite direction. The carrying shoulders 5 on the frame 1 and the locking shoulders 9 of the locking member 6 are so disposed, two and two, that both locking shoulders 9 of the locking member on both ends of each strip will become locked against the undersides of the respective carrying shoulders 5 of the frame. Thus the carrying shoulders 5 on the carrying side are arranged, two and two, to interact with the corresponding locking shoulders of the respective locking members and disposed to interlock with them.

In FIG. 1 are seen depressions 11 which have been formed in the carrying sides 2,3 to receive the limiting members 7 of the strips.

In FIGS. 2–4 is seen the detailed construction of the strip and of its locking members.

The strip constitutes a unitary row of microtitre wells (14) carrying a locking member 6 on either end. In the embodiment here depicted, the small walls (14), resembling test tubes, have been cast contiguous to each other in a straight row or line, and on the ends of the row have been affixed locking members 6, i.e., spring members 10. The spring member 10 attaches to the assembly on the level of the well bottom (FIG. 2) and it ascends at a slight outward inclination relative to the wells and forms in its upper part, close to the plane of the upper surface of the wells, a limiting member projecting outward in the longitudinal direction of the strip. On the spring member, below the limiting member and on both sides of the spring member, locking shoulders 9 have been formed. The strip, together with its locking members 6, has been shaped by casting in a single work step, e.g. of plastic. If desired, one may equally use, for instance, an oblong frame instead of a unitary strip, such frame being provided with apertures or receptacles for separate cups resembling test tubes and each one constituting a well.

The locking member 6 comprises, in the embodiment depicted, a substantially vertical spring member 10 and a limiting member 7 projecting away therefrom in the longitudinal direction of the strip. The spring member and the limiting member, as well as the entire strip, are made of elastic plastic. The locking shoulders 9 consist of shoulders formed on the spring member which project outward, i.e., symmetrically to both sides in the longitudinal direction of the strip. Furthermore, in the embodiment depicted, the locking shoulders 9 are located on a level lower than the underside of the limiting members 7 (FIG. 2 and FIG. 4), the top surface of the locking members substantially flush with the underside of the limiting members. The outer surfaces of the locking shoulders are shaped to be, as seen from below, outward sloping or inclined, so that the inclined surfaces will push in wedge fashion past the carrying shoulders on the frame, urging the spring member inward when the strip is pushed in place; at the end, the spring members will snap in place and become locked as the top surfaces of the locking shoulders 9 are locked against the undersides of the carrying shoulders 5 of the particular strip.

In the embodiment example, one cuvette matrix, that is, a microtitre tray, conforming to the invention has been described. The invention can, however, be applied to any kind of cuvette matrix whatsoever which presents strips composed of cuvettes. It should also be noted that the strips may equally present depressions for cuvettes or for cups constituting microtitre wells, i.e., the cuvettes and/or cups may be separate from the strips.

The embodiment example is merely means to illustrate the invention, and embodiments of the invention may vary within the scope of the claims following below.

I claim:

1. A cuvette matrix tray, comprising a frame (1) with two parallel carrying sides (2,3) having upper surfaces (8) and a plurality of strips (4) which are mounted between said carrying sides, each said strip (4) being a unitary row of microtitre wells (14), each strip having an undersurface, characterized in that on both carrying sides (2,3) of the frame (1) are formed inward projecting carrying shoulders (5), said carrying shoulders having undersides, and that on both ends of the strips is provided a locking member (6) comprising an outward projecting limiting member (7) disposed to rest against the upper surface (8) of the carrying side, and two locking shoulders (9) projecting at right angles relative to the longitudinal direction of the strip and in opposite directions to each other and disposed to be pressed in below two adjacent carrying shoulders and to rest against the undersides thereof when the strip is pushed from above between the carrying sides, said locking member further comprising a substantially vertical spring member (10), said limiting member (7) projecting outward therefrom, and said substantially vertical spring member being attached to said undersurface of said strip.

2. Cuvette matrix tray according to claim 1, wherein each locking shoulder (9) is a shoulder formed on said spring member and projecting outward therefrom below said limiting member (7).

3. Cuvette matrix tray according to claim 1, characterized in that on the carrying sides (2,3) have been formed depressions (11) and the limiting members (7) are disposed in said depressions.

* * * * *